US005077844A

United States Patent [19]

Twitchell et al.

[11] Patent Number: 5,077,844

[45] Date of Patent: Jan. 7, 1992

[54] MECHANICAL APPARATUS FOR LIFTING AND MOVING HUMANS

[76] Inventors: Kendel S. Twitchell, 1569 Shenandoah Cir., Bennion, Utah 84123; Elden K. Twitchell, 10523 S. North Forty Way., South Jordan, Utah 84065

[21] Appl. No.: 440,591

[22] Filed: Nov. 22, 1989

[51] Int. Cl.[5] ..... A61G 7/10

[52] U.S. Cl. ..... 5/87; 5/81 R; 212/232; 414/921

[58] Field of Search ..... 5/81 R, 83, 87; 212/232, 237, 255, 247, 248; 4/560, 561, 562, 564; 414/921

[56] References Cited

U.S. PATENT DOCUMENTS

| | | | |
|---|---|---|---|
| 3,104,399 | 9/1963 | Dalton | 4/562 |
| 3,203,009 | 8/1965 | Lundberg | 5/81 R |
| 3,659,594 | 5/1972 | Schwab | 5/87 |
| 3,760,956 | 9/1973 | Burch | 212/247 |
| 4,571,758 | 2/1986 | Samuelsson | 5/87 |
| 4,589,518 | 5/1986 | Kohzai | 212/247 |
| 4,606,082 | 8/1986 | Kuhlman | 414/921 |
| 4,704,749 | 11/1987 | Aubert | 5/83 |

FOREIGN PATENT DOCUMENTS

| | | | |
|---|---|---|---|
| 2414909 | 8/1979 | France | 5/81 R |

OTHER PUBLICATIONS

"Medical Brobotics—Why, What and When" by Finlay, from *The Industrial Robot*, vol. 16, No. 1, Mar. 1989.

*Primary Examiner*—Gary L. Smith
*Assistant Examiner*—F. Saether
*Attorney, Agent, or Firm*—Trask, Britt & Rossa

[57] ABSTRACT

An invalid lifting device is disclosed. A mast is mounted to a frame to rotate about a vertical axis. A boom is mounted to the mast to swing with the mast and to pivot about a horizontal axis. A sling for supporting an invalid extends from the end of the boom. A first motor drives the mast to rotate and a second motor is mechanically linked with an extendible strut to raise and lower the boom. A control box is provided in the proximity of an invalid as he is seated in the sling to allow the user to select an elevational and rotational movement. A computer controls movement of the device based upon input at the control box.

19 Claims, 8 Drawing Sheets

MECHANICAL APPARATUS FOR LIFTING AND MOVING HUMANS

BACKGROUND OF THE INVENTION

1. Field

The present invention is directed toward a lifting device for lifting and moving persons such as invalids.

2. State of the Art

Persons having a limited or lack of mobility in their extremities often have a difficult time transferring between locations such as a bed, wheelchair, bathroom facilities, therapeutic pool, etc. Such transfers of position often require another person or persons to help the patient from one place to another. In view of this difficulty, certain devices have been developed for mechanically aiding in lifting and moving invalid persons.

U.S. Pat. No. 3,877,421 (Brown) discloses a mast mounted upon a moveable base with a boom extending laterally from the top of the mast. The base is set on coasters and is "U"-shaped so that it can be positioned around the patient's bed. A sling extends downward from the distal end of the boom. A brace or strut extends between the boom and the mast, which strut is connected to a mechanical jack mounted vertically with the mast. An operator can crank this mechanical jack to raise or lower the bottom end of the strut, and thus raise or lower the boom. Once the patient is in the sling, and the boom raised, an operator can then move the person about with the entire frame on its casters to move the patient to a desired location.

U.S. Pat. No. 3,677,424 (Anderson) discloses a mast and boom assembly that is designed to be fixed to a rigid object, such as a car door, or between a ceiling and floor (see FIG. 7). A rotating screw jack is positioned between the boom and the mast to raise and lower the mast to lift the patient in a sling extending downward from the distal end of the boom.

A problem with the disclosed devices is that they require mechanical cranking or jacking by some means to raise and lower the patient. In addition, to rotate the person about the mast, either the invalid or a helper must physically push the invalid about the vertical axis of the mast. Particularly with devices such as the Brown lift, an operator, apart from the patient, would need to move the entire assembly about. A requirement that either an operator or the invalid himself jack the boom up and down or swing the boom is disadvantageous. Such physical movement may be inconvenient and difficult.

There remains a need for an invalid lifting device that is motorized or otherwise powered in both lifting and rotating functions, and that has controls operable by the invalid himself so that he can cause himself to be moved about without the assistance of another person.

SUMMARY OF THE INVENTION

The present invention provides a human lifting device. A frame is provided that may be positioned on a floor structure, a wall, or otherwise to provide a rigid structural basis from which lifting and rotating functions of the device can operate. A mast is mounted to the frame to rotate about a generally vertical axis. Lifting means is mechanically associated with the mast for rotating with the mast and for selectively moving a person up and down. First drive means is mechanically linked with the mast for selectively urging the mast to rotate about the generally vertical axis. Second drive means is mechanically linked with the lifting means for selectively driving the lifting means to move the person up or down. Input means is associated with the lifting device for receiving rotational signals and elevational signals from an operator. Computer means is associatively linked with the first drive means, the second drive means, and the input means for selectively controlling the first drive means and the second drive means. The computer means is programmed to: read rotational data from the input means, read elevational data from the input means, control the first drive means according to the rotational data, and control the second drive means according to the elevational data. In one embodiment, the lifting means may include a boom pivotally attached to the mast to pivot up and down about a generally horizontal axis.

The input means may further include speed selection means for receiving a selected rotational speed at which the first drive means is to operate. The computer means may further be programmed to control the first drive means according to this selected rotational speed. In one embodiment, the computer means may be programmed to control the speed of the first drive means by operating the first drive means in a duty cycle mode. The computer means may also be programmed to start and to stop the first drive means on a gradual basis.

The first drive means may include a motor. This motor may be drivingly connected to the mast by means of a pinion gear. The second drive means may include a second motor. The second motor may be drivingly connected to the boom by means of a screw gear.

Human lifting devices of the invention provide mechanisms for lifting invalids that are powered in both up and down functions and rotational functions. The device includes an input mechanism that can conveniently be operated by the invalid himself or by an operator. Preferred embodiments of the device include means for allowing the invalid or an operator to select a preferred rotational speed for the mast and boom assembly. The device advantageously includes a computer that is programmed to operate various mechanical aspects of the device according to input received from a user or operator.

DETAILED DESCRIPTION OF THE ILLUSTRATED EMBODIMENT

Figure 1:
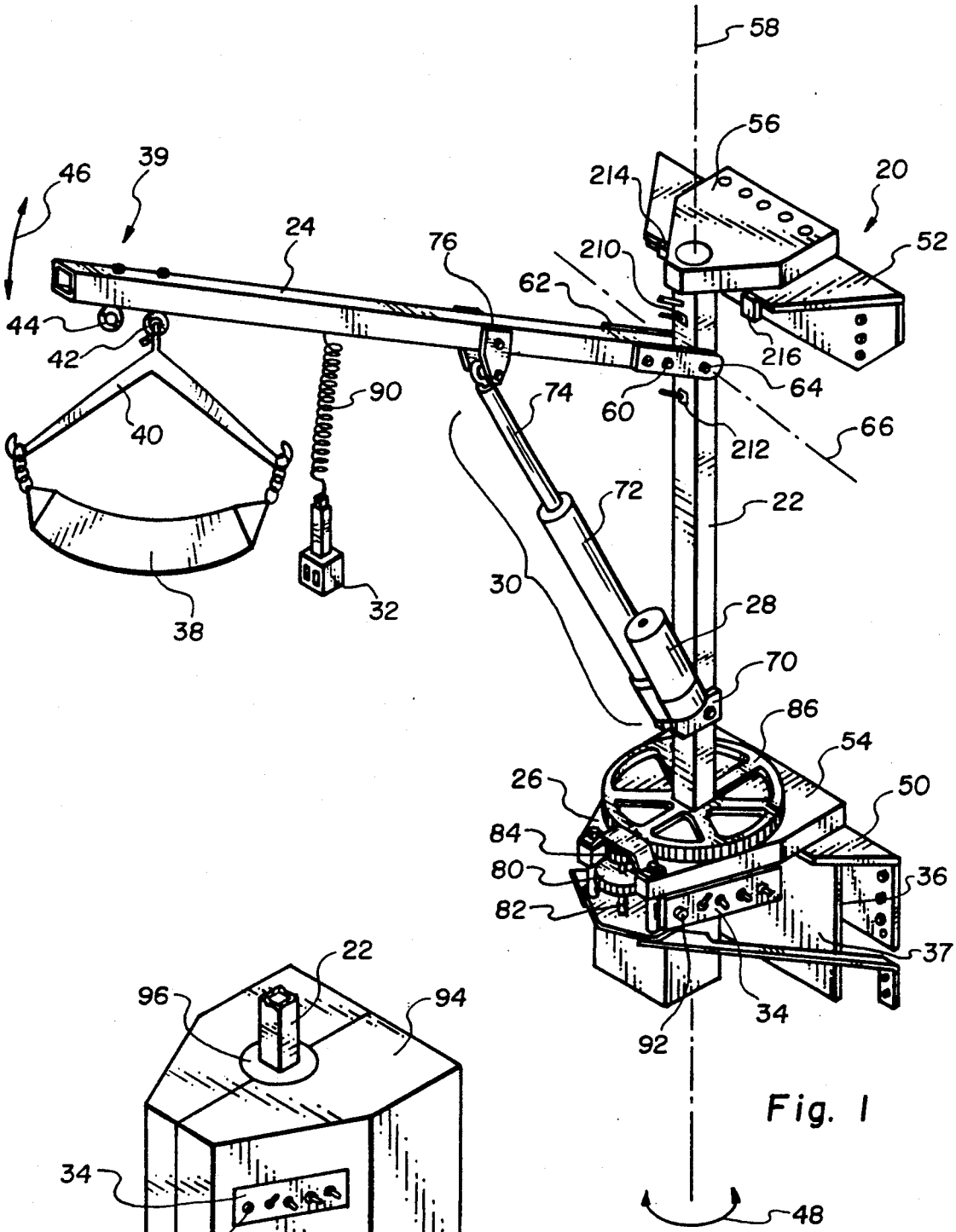
FIG. 1 is a perspective illustration of a human lifting device of the invention.

Referring to FIG. 1, the illustrated human lifting device of the invention includes a frame generally indicated at 20, a mast 22, a boom 24, a rotation motor (not shown), a lifting motor 28, an extendible strut 30, a control box 32, a switch panel 34, and a computer 36 (not shown in FIG. 1, mounted behind plate 37). A sling is attached to the distal end 39 of boom 24 by means of a yoke 40, which links with either of the eyelets 42 or 44.

Generally, a user seats himself in sling 38 and grasps control box 32 with one of his hands. The user then operates the buttons on control box 32 to cause boom 24 to move up or down (see double arrow 46) or to cause the mast 22 and boom 24 assembly to rotate either clockwise or counterclockwise (see double arrow 48). By thus operating the controls of box 32, the user can reposition himself at various locations and thereby transfer himself, for example, from a wheelchair to a jacuzzi, or from a bed to a wheelchair, etc. The operation and use of the lifting device is described more completely infra.

Frame 20 includes a lower bracket 50 and an upper bracket 52. Brackets 50 and 52 are designed to be mounted to a wall or other structure to provide rigid support for other members of the lifting device. In the illustrated embodiment, brackets 50 and 52 are adapted to be mounted to a wall structure by means of heavy screws. Brackets 50 and 52 may also be adapted to be connected to a vertical pole mounted to a floor surface. Such a pole-mounted system would be advantageous, for example, near a therapeutic pool where no conveniently positioned wall structure is available for mounting of the frame.

A lower support member 54 is firmly attached to bracket 50 by means of, for example, welding or bolts. An upper support member 56 is similarly attached to upper bracket 52. Mast 22 is rotationally attached between support members 54 and 56 by appropriate bearings. Useful bearings have been found to be tapered roller bearings. The tapered roller bearings are mounted in support member 54 with the taper of the outer race opening towards the top as viewed in FIG. 1 and a similar tapered roller bearing is mounted in support member 56 with the taper of the outer race opening up towards the bottom of support member 56 as viewed in FIG. 1. Thus, the roller bearings mounted in support member 54 provide an upward and inward resultant resistive force, while the roller bearings mounted in support member 56 provide a downward and inward resultant resistive force against any forces that may be acted upon support members 54 and 56 by mast 22. Mast 22 is thereby firmly supported yet allowed to pivot about a generally vertical axis 58 with respect to frame 20.

Boom 24 is pivotally attached to mast 22 by means of brackets 60 and 62, which are attached by an axle 64 to mast 22, to provide a pivot point at the position of axle 64. Boom 24 pivots about a generally horizontal axis 66, which axis rotates in space about vertical axis 58 as mast 22 and boom 24 rotate about axis 58.

Strut 30 is connected at its lower end by means of bracket 70 to mast 22, to thereby be allowed to pivot with respect to mast 22. Strut 30 includes a lower receiving member 72. Strut 30 also includes a shaft 74 that is telescopingly received within member 72, as shown. Shaft 74 is connected at its upper end by means of a bracket 76 to boom 24, as shown, to thereby allow shaft 74 to pivotally associate with boom 24.

Motor 26 is attached to frame 20 and is drivingly connected to mast 22 to rotate mast 22 based on signals it receives from computer 36. Motor 26 is adapted to be powered by 12 volts and is linked with mast 22 by a two-stage gear reduction. Motor 26 includes a vertical shaft (not shown) to which is connected a pinion gear (not shown), which is in turn connected to a larger gear 80 mounted on axle 82. A second pinion gear 84 is mounted concentrically to gear 80 and is turn engaged with a larger wheel gear 86, directly connected to mast 22, as shown. Motor 26 is electrically connected to computer 36 in a manner more completely described hereinafter. Computer 36 controls motor 26, to rotate, by means of gears 80, 84, and 86, to rotate mast 22 and thereby boom 24 about axis 58 in either rotational direction, i.e., either clockwise or counterclockwise (double arrow 48), based upon input received from the user at control box 32.

Shaft 72 is telescopingly received into cylinder and is connected by means of a screwdrive to motor 28. Motor 28 is electrically connected to computer 36 in a manner described more completely hereinafter. Computer 36 is adapted to electrically energize motor 28 to rotate in either of two rotational directions to thereby either extend shaft 74 from cylinder 72 or to retract shaft 74 back into cylinder 72, to either raise or lower boom 24, respectively. Strut 30 is therefore extendible or retractable.

The assembly of strut 30 and motor 28 may be purchased as an off-the-shelf item. A usable assembly is a Linear Actuator, available from Warner Electric Brake and Clutch Company, model no. D12-21B5-12M3. Motor 28 is mechanically linked by means of pinion and wheel gears to a screw gear. Rotation of motor 28 urges longitudinal motion of shaft 74.

Although strut 30 is disclosed to be comprised by a cylinder and a shaft in which the shaft is extended or retracted into the cylinder by means of a gearing relationship, a usable strut may also be provided by a hydraulic cylinder assembly. A motor may be mounted in the position of motor 28 or elsewhere on the apparatus and linked by means of a hydraulic fluid line to a hydraulic cylinder located in the position of and having a similar appearance to strut 30. At present, a mechanically geared strut is believed to be preferable as avoiding the potential of any leakage of hydraulic fluid.

Control box 32 is electrically connected by means of cord 90 to computer 36. Cord 90 is an elastically coiled electrical cord. Control box 32 is positioned so that a user seated in sling 38 can easily grasp it to manipulate the buttons on it. Control box 32 has an up and down button, a right and left button, and an attendant call button. Toggle switch panel 34 contains four toggle switches, as shown. These toggle switches are electrically connected with computer 36.

Figure 1A:
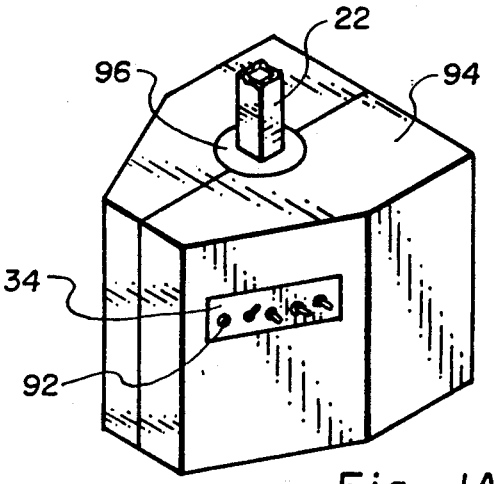
FIG. 1A is a perspective, partial sectional view of a housing assembly of the invention.

The entire lower assembly, including bracket 50, support member 54, and the various gears, including gear 86, are mounted in a shroud or housing 94 as shown in FIG. 1A. A water-tight seal 96 is fitted into housing 94 and around mast 22. Seal 96 keeps water from entering housing 94 to avoid electrical problems with computer 36, motor 26, or other problems. Seal 96 also precludes dirt and other debris from doing damage to components within housing 94.

Figure 2:
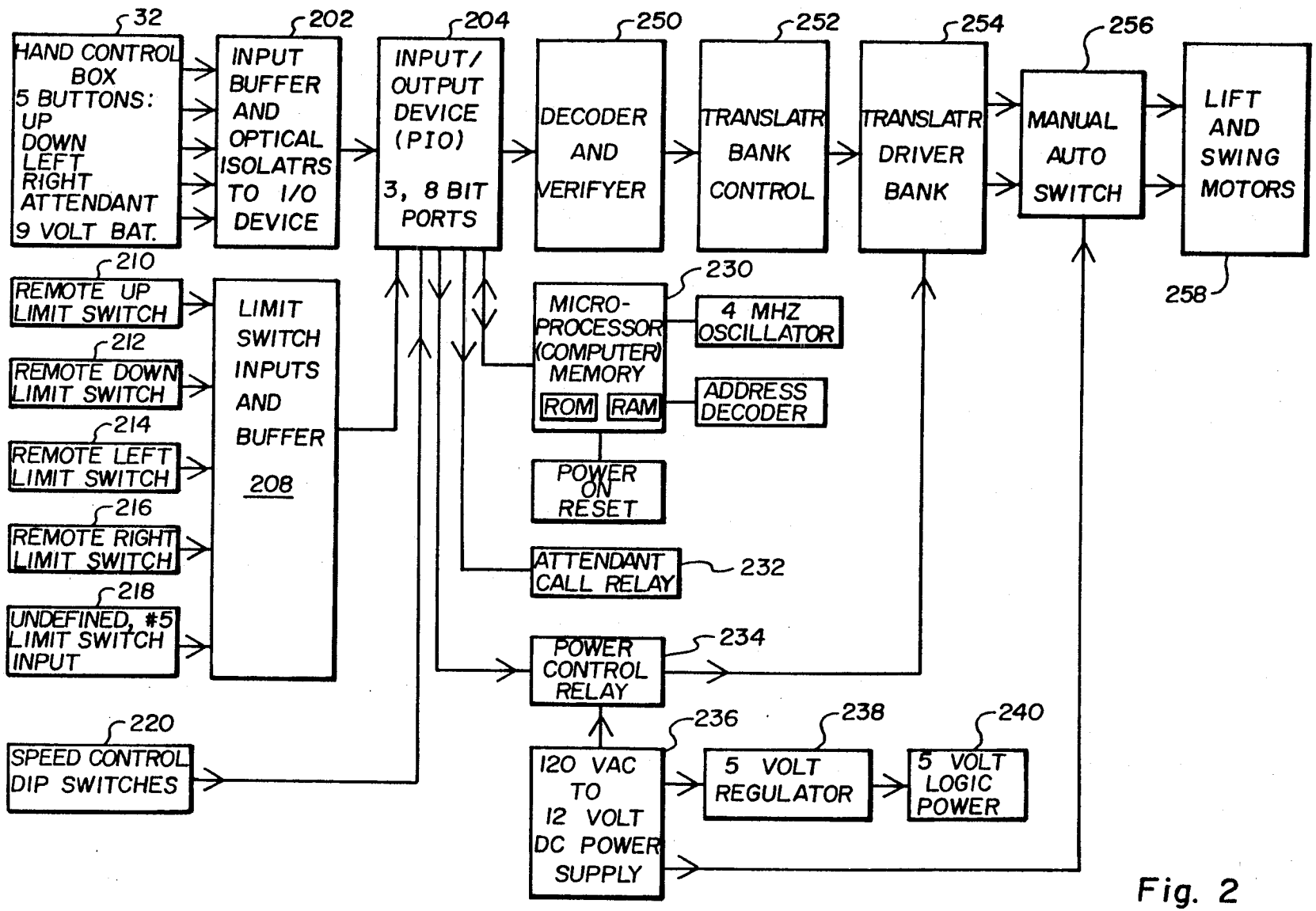
FIG. 2 is a block diagram of control circuitry of the invention.

FIG. 2 is a block diagram of circuitry, including the microprocessor, used to control the human lifting device of FIG. 1. More specific details of this circuitry are disclosed in reference to FIGS. 3 through 7, which are schematic circuit diagrams. Referring to FIG. 2, hand control box 32 includes five buttons: an up and a down button to control motor 28, a left and right button to control motor 26, and an attendant call button, which an invalid or patient may use to call an attendant, such as a nurse.

Hand control box 32 is connected as shown to input buffer and optical isolator 202. If an electrical spark or static shock occurs at hand control box 32, components connected to the right, as shown in FIG. 2, of input buffer and optical isolator 202 are protected. In addition, if a failure were to occur at hand control box 32, the only direct electrical connection to power at hand control is the 9 volt battery indicated in hand control box 32. This electrical isolation may be particularly important when the lifting device is used in a wet environment, such as near a pool or a tub.

Input buffer and optical isolator 202 is connected to a parallel input/output (PIO) 204. PIO 204 has three 8-bit ports. Two of these ports are inputs and one of them is an output.

PIO 204 is connected as shown to a limit switch input and buffer 208. Limit switch input and buffer 208 is in turn connected to limit switches 210, 212, 214, 216, and 218. Sensing means including limit switches 210 and 212 are positioned on frame 20 to register the vertical motion of boom 24 to indicate when the boom has moved too far in one direction. Similarly, sensing means including limit switches 214 and 216 are connected to indicate when boom 24 has rotated too far to the left or too far to the right, respectively, sensing means including limit switches 218 is undefined. However, the input is provided to allow an installer to provide a limit switch for the particular application for the lift involved. Limit switches 210 through 218 may be mechanical or magnetic switches. When the maximum limit is reached, the switch is closed.

PIO 204 is also connected to speed control dip switches 220, which are located on the circuit board, as discussed, infra. By means of speed control dip switches 220, an operator can select an appropriate speed for the rotational movement of mast 22 in response to rotation of motor 26.

PIO 204 is also connected to microprocessor or computer 230. As shown, microprocessor 230 includes a read only memory (ROM) and a random access memory (RAM). Microprocessor 230 is the brain of the device that operates the device according to programming contained in memory.

PIO 204 is also connected to attendant call relay 232. This relay is engaged with a buzzer, light, or other attention-getting mechanism. A user depresses the attendant call button of hand control box 32 to activate relay 232 to thereby summon a nurse or other attendant.

PIO 204 is also connected to power control relay 234. Power control relay 234 is used to engage motors 26 and 28 to physically manipulate the lifting device. As shown, a 120 volt power supply converter 236 is connected to power control relay 234. Converter 236 supplies the 12 volt power to power control relay 234 to operate motors 26 and 28. Converter 236 is also connected to 5 volt regulator 238 to provide 5 volt logic for the logic circuitry of the system. Therefore, as shown, 5 volt regulator 238 is connected to the 5 volt logic power 240 of the system.

PIO 204 is also linked to decoder and verifier 250. Decoder and verifier 250 verifies that no illegal commands are transmitted to the remainder of the system. Decoder and verifier 250 is connected as shown, to transistor bank control 252, which is in turn connected to transistor driver bank 254. As shown, power control relay 234 is also connected to transistor driver bank 254 to provide 12 volt power, which transistor driver bank 254 delivers power ultimately to motors 26 and 28.

Transistor driver bank 254 is connected as shown to manual auto switch 256, which is connected as shown to lift and swing motors 258. The lift motor is motor 28, and the swing motor is motor 26. Manual auto switch 256 allows a user to override the automatic and computerized switching of the motors. In a manual mode, there is no electrical isolation and no speed control for swing motor 26.

A more complete description of the circuitry is now made in reference to FIGS. 3 through 7. A parts list setting forth components on these schematic diagrams is here included as Table 1.

TABLE 1

| Identification | Part No. | Description |
|---|---|---|
| B1 | AL-9 V | Battery 9 V ALK |
| B2 | | Battery 12 V 20 Alt Gell Cell |
| BR1 | SK9101 | BRIDGE RECT40 A |
| C1 | C100.0 pf | CAP DISC |
| C12 | C47.0 uf | CAP ELECTRYLTC |
| C14 | C750.0 pf | CAP SILVER DIP |
| C16 | C20000.0 uf | CAP ELECTRYLTC |
| C . . . | C00.1 uf | CAP DISC |
| C4 | C3300.0 uf | CAP ELECTRYLYTC |
| C8 | C02.2 uf | CAP TANTALUM |
| D1-9 | IN4004 | DIODE |
| D10 | | DIODE 30 A |
| F1 | AGC01.5 A | FUSE 1.5 A FBLO |
| F2 | AGC10.0 A | FUSE 10 A FBLO |
| F3 | AGC20.0 A | FUSE 20 A FBLO |
| F4 | MDL3.0 | FUSE 3 A SLOBLO |
| K1 | T90S1D12—12 | POWER RELAY |
| K2 | W171DIP-4 | IC MOUNT RELAY |
| LED1 | LED | LED |
| J1,2 | 25-600-0853 | 6 PIN FEM-PLUG |
| P1,2 | 25.584.2125 | PIN STRIP |
| PB1-5 | | BUTTON SPST MO |
| Q1,2,5,6 | 2N6287 | PNP TRANSISTOR |
| Q3,4 | 2N6284 | NPN TRANSISTOR |
| Q7,8 | 2N3904 | TRANSISTOR NPN |
| S1 | 7500K13 | SWITCH SPST |
| S2 | 7694K4 | SWITCH 4PDT |
| S3,4 | 35-150-BU | SWITCH 2PDT SP |
| S4,S5 | V3L6D8 | SWITCH SPST MS |
| SW1 | 206-4 | SWITCH DIP 4S |
| T1 | RT-2012 | TXFORMER 20 A |
| TB1 | 73504 | TERMINAL STRIP |
| TB2 | 73510 | TERMINAL STRIP |
| TF1 | 4-161-1 | STRIP FANOUT |
| TF2 | 10-161-1 | STRIP FANOUT |
| U1-3,12-14 | MCT6 | OPTO-ISOLATOR |
| U11 | 82S123 | PROM 32 BYTE |
| U15 | LM309K | 5 V REGULATOR |
| U4, 10 | 74S04 | HEX INVERTER |
| U5 | P8255 | I/O PORT |
| U6 | Z0840004/PSC | CPU Z80-B |
| U7 | AM2764-25 | EPROM 8K × 8 |
| U8 | 6264P-2 | RAM 8K × 8 |
| U9 | 74S139 | I/O DECODER |
| VR1 | V130LA10 A | MOV PROTECTOR |
| Y1 | | CRYSTAL 3.545M |

Note:
Resistor values on schematic circuit diagrams are in Ohms, K = 1000. All resistors are ¼ watt.

Figure 3:
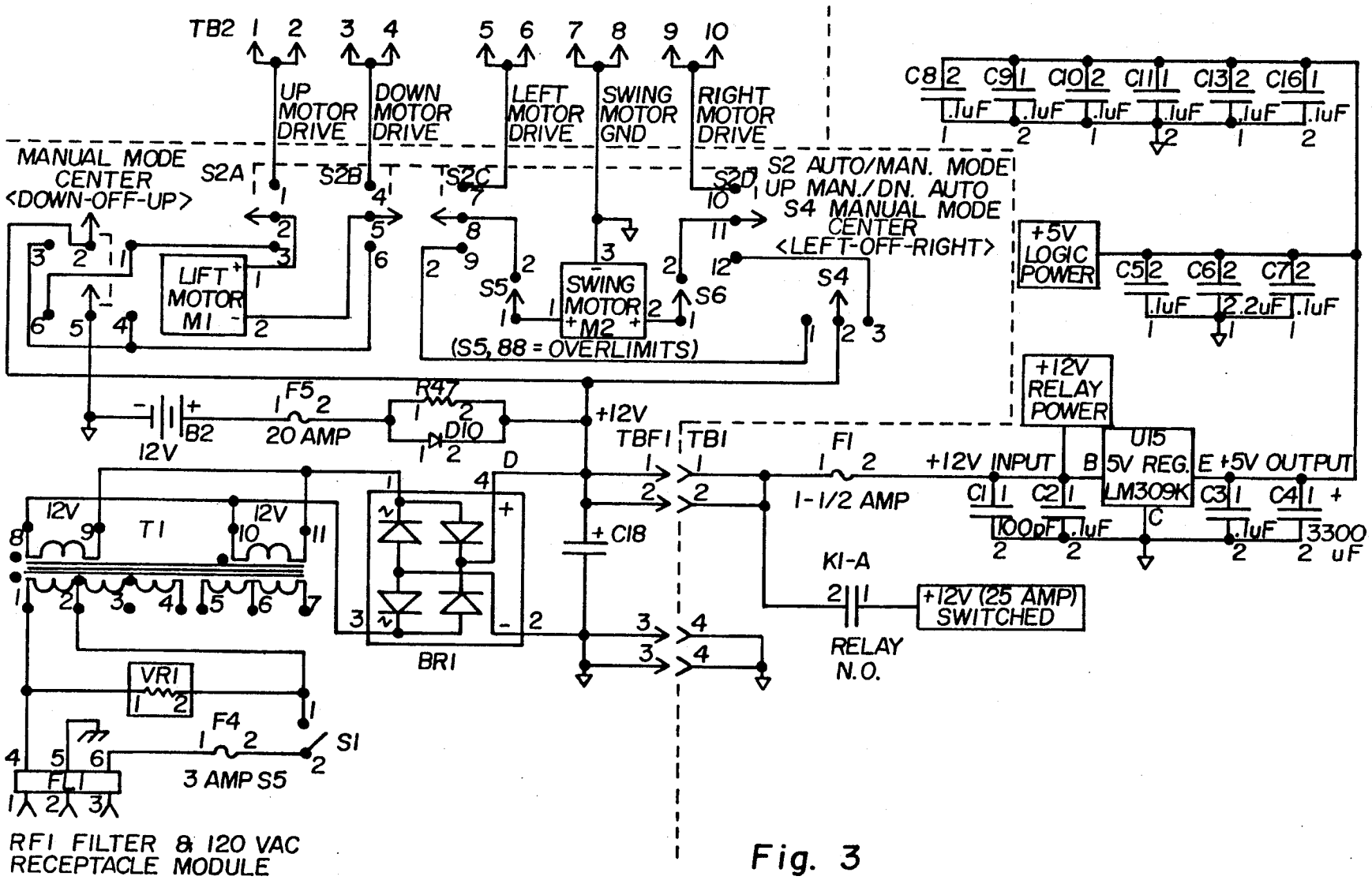
FIGS. 3–7 are schematic circuit diagrams of control circuitry of the invention.

Referring to FIG. 3, in the lower left-hand corner, terminals 1, 2 and 3 are connected as shown through an AC cord to 120 AC current. As shown, there is a 3 amp slow-burn fuse (F4) in series with the AC cord and the transformer T1. Fuse F4 is slow burn so that it will not burn out on the inductive surge of the transformer as the device is turned on. The device labeled VR1 is what is referred to as a metal oxide varistor. As the voltage from the line to which it is connected exceeds the required voltage of the device, it will either blow an internal fuse or will self destruct in the attempt to eliminate any large voltage transients. Transformer T1 contains various voltage taps that may be adjusted to accommodate the particular AC line voltage of the location where the device is used.

The output of transformer T1 is 12 volts AC. As shown, transformer T1 has two secondary windings, one between taps 8 and 9, and the other between taps 10 and 11. The power radiant of transformer T1 is 22 amps. The 12 volts AC produced by transformer T1 enters the module labeled BR1, which is a rectifier, to convert the 12 volts AC to 12 volts DC. Rectifier BR1 is an NTE-5342, 40 amp module.

As shown, capacitor C16 is connected between terminals 2 and 4 of module BR1. This capacitor is used to correct for a problem referred to as a "power factor," which is created by the motors. Capacitor C16 filters out much of the electrical noise generated by the motors 26 and 28, as well as remaining AC ripple, that appears on the 12 volt AC line.

Resistor R47 limits the amount of charging current going into battery B2. The resistance of R47 is selected based on the voltage and the type of battery used. The chosen resistor for the illustrated embodiment is referenced on the parts list, infra. Component D10 is used to switch out this resistor during the time that battery B2 powers the lifting device. Battery B2 permits the lifting device to continue to operate in the event of an AC power failure. Battery B2 is protected by a fuse F5, which is selected based on the type of battery used. As shown, battery B2 is a 12 volt 20 amp gel cell, and fuse F5 is a 20 amp slow burn fuse.

The 12 volts DC produced by the power supply enters the circuit board to the right of the dotted line at TB1. Terminals 1 and 2 are the positive 12 volt input and terminals 3 and 4 are connected to ground. As the DC 12 volts enters the circuit board at TB1, it passes through a 1½ amp fuse F1 and then into module U15, which is a LM309K 5 volt regulator. This regulator reduces the 12 volt DC down to a regulated constant 5 volts to power the computer and to provide a 5 volt high for the logic of the system. It is very important that this 5 volts be carefully maintained. Capacitors C1, C2, C3, C4, C5, C6, C7, C8, C9, C10, C11, C13, and C16 all act as despiking capacitors. These capacitors act like small batteries to their respective individual integrated circuits. As the integrated circuits conduct their switching functions, they may at various times draw a relatively large amount of extra current. These spikes of current draw are controlled by these despiking capacitors.

The 12 volts entering the system at TB1 is also connected to a terminal or set of contacts K1-A. Terminal K1-A is a heavy power relay that is normally open. In other words, relay K1-A does not conduct the 12 volts into the transistor banks to enable motors 26 and 28 until the computer enables relay K1-A. Relay K1-A is therefore referred to as the transistor bank enable relay.

Figure 4:
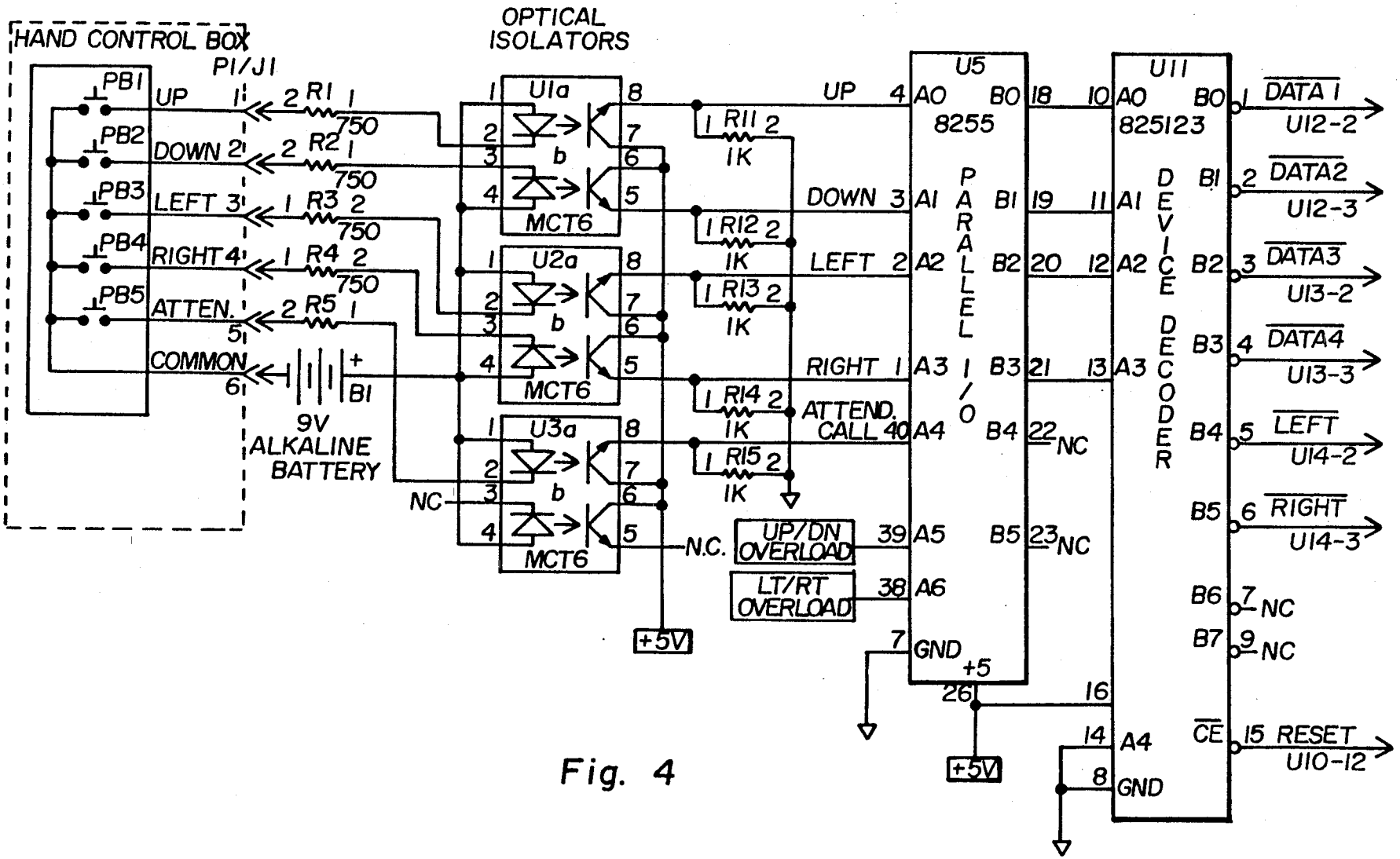

Switch S2 switches the system between automatic mode and manual mode. The normal condition of the system is the automatic mode, in which the computer controls the lift motor 28 (Motor M1) and swing motor 26 (motor M2) based on input from hand control box 32 (FIG. 4). When switch S2 is switched up, the device is in its manual mode, and when switch S2 is switched down, the device is in its automatic mode.

After switch S2 has been switched to its manual mode, lift motor M1, or swing motor M2, may be operated manually. As shown, lift motor M1 is connected to a switch S3, which has 3 positions, down, off, and up. When switch S3 is in its "off" or center position, nothing happens. Switch S3 is in this position during normal operation of the unit with switch S2 in its automatic position. For this reason, switch S3 is spring loaded to move to the center "off" position when it is released by the user. By moving switch S3 either down or up, lift motor M1 can be caused to operate the boom either down or up, respectively.

Similarly, swing motor M2 is connected to switch S4, which has 3 positions, left, off, and right. Switch S4 is spring loaded to move to the center off position when not operated by the user. By moving switches S4 to either the left or the right, the user can cause swing motor M2 to operate the boom either to the left or the right, respectively.

When switch S2 is in its normal or automatic mode, switches S3 and S4 are disabled, and motors M1 and M2 are connected to the terminals TB2, shown at the upper left of FIG. 3, which include terminals 1 through 10, as shown. Terminals 1 through 10 are parallel. Terminals 1 and 2 are connected, 3 and 4 are connected, 5 and 6 are connected, 7 and 8 are connected, and 9 and 10 are connected, as shown. These double connections advantageously increase the current capacity of the terminal strip, since motors M1 and M2 draw a relatively large amount of current.

Lifting motor M1 is a two-wire motor. In order to reverse the direction of the motor, the polarity of the motor must be reversed. Therefore, motor M1 has a positive and a negative terminal. Swing motor M2 has two separate motor windings and a common ground. In order to turn one direction, power is applied to one winding. In order to turn the other direction, power is applied to the other winding.

Referring to FIG. 4, the hand control box is depicted in the upper left-hand corner. As previously described in reference to FIG. 5, the hand control box has five buttons, which are spring loaded push buttons, "up," "down", "left," "right," and "attendant call." The attendant call button is optional and may be used in a hospital or other setting to alert a nurse or other attendant. This button may connect, for example, to a plug on top of the circuit board. When the attendant call button is depressed, the computer is caused to restart itself, and to lock up in a function that only allows the alarm to be operated. When the attendant call button is depressed, all motor operation is disabled and shut down. Therefore, this button also functions as a "panic" or reset button.

The hand control box is connected as shown to the circuit board at three optical isolators, which are MCT6 chips, as shown in FIG. 4. These three MCT6 chips are labeled U1, U2, and U3. These chips have an electrical breakdown voltage of about 5,000 volts. At any electrical potential under 5,000 volts, the only connection from one side of the device to the other is a light beam. Therefore, the hand control box is isolated up to about 5,000 volts from any source, for safety purposes.

Resistors R1, R2, R3, R4, and R5 of FIG. 4 are connected as shown for current limiting purposes in order to protect the optical isolators U1, U2 and U3. In addition, these resistors would also limit the amount of current that might flow through to a human holding the handle control box should, for example, the optical isolators not function as intended. The hand control box is powered by a 9 volt alkaline battery B1, which is physically located on the circuit board, but may alternatively be placed inside of control box 32. Hand control box 32 and its 9 volt power source are represented by block 200 of FIG. 5. Optical isolators U1, U2, and U3 are represented by block 202 of FIG. 5.

Optical isolators U1, U2, and U3 are connected to the parallel input/output (PIO) U5, which is an 8255 chip as shown. The PIO U5 is represented by block 204 of FIG. 5. In turn, the PIO U5 is connected to device decoder U11, which is an 82S123 chip. Device decoder U11 is represented by block 250 of FIG. 5.

A typical flow of information through the circuits shown in FIG. 4 is now described. If the button PB1 of the hand control box is depressed, the light emitting diode U1*a* of optical isolator U1 is turned on to emit light. Photons emitted from LED U1*a* turns on the base of the transistor next to diode U1*a*. The 5 volts connected to terminal 7 of optical isolator U1 is then connected to terminal 8. This 5 volts is then connected to PIO chip U5 at pin 4.

The microprocessor (described hereinafter) is constantly reading the inputs at PIO U5, which are labeled A0, A1, A2, A3, and A4. As the microprocessor reads 5 volts at pin 4 (i.e. input A0), the microprocessor is told that the "up" button has been pressed. At such time, assuming everything else is working normally, the microprocessor is programmed to send a signal at approximately 5 volts out at terminal 18 of PIO U5, which is labeled output B0. This 5 volts is fed into the device decoder U11. Device decoder U11 is programmed to insure that the up and down function are not both enabled at the same time. If either the up and down or the left and right function are enabled at the same time, the device decoder U11 cancels the request and does not output any data on the output lines labeled data 1, data 2, data 3, or data 4, which are at terminals 1, 2, 3, or 4, respectively, of device decoder U11. Data lines 1 through 4 and the left and right outputs at terminals 5 and 6 of device decoder U11 are fed into the transistor bank control lines at the left edge of FIG. 5.

Figure 7:
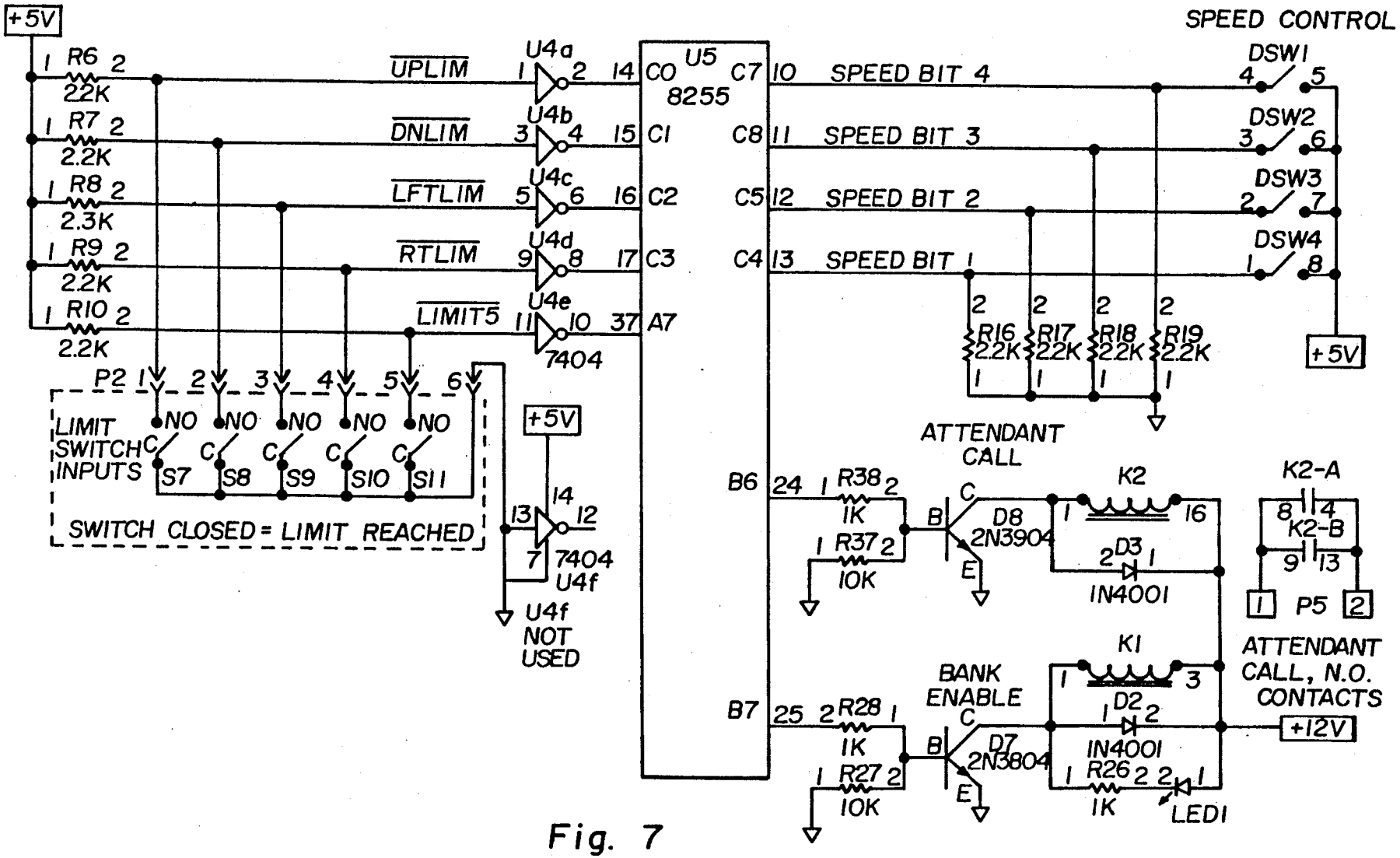

Therefore, assuming a single function has been selected, such as up or down, left or right, the computer enables the bank enable relay labeled "K1" on FIG. 3 and also shown in the lower right-hand corner of FIG. 7. The computer operates relay K1 and waits approximately 15/1000ths of a second in order for relay K1 to stop bouncing before power is applied to the appropriate motor. This delay reduces radio frequency (RF) interference to local radios, etc. and prolongs relay life.

Figure 5:
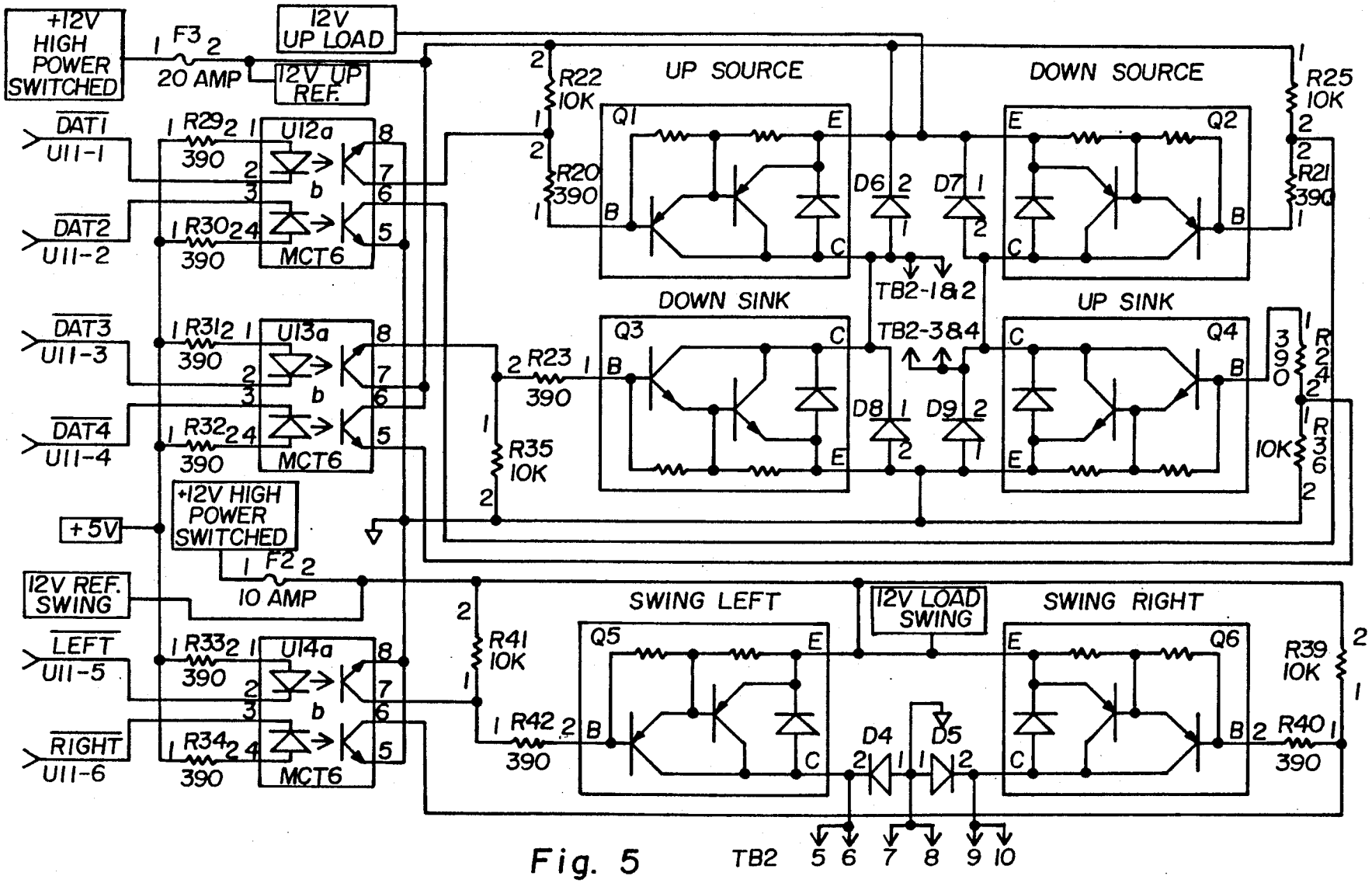

Referring to FIG. 5, the data lines 1 through 4 and the left and right lines referred to enter the left side of the figure. These data lines enter optical couplers U12, U13, and U14, as shown, similar to the input from control box 32. Couplers U12, U13, and U14 are not used for electrical isolation or safety but as a means of biasing or controlling transistors Q1, Q2, Q3, Q4, Q5, and Q6. Q1 through Q6 are Darlington-type 20 amp transistors.

The data lines, data 1 through 4 and left and right at the left side of FIG. 5 are in an active condition in the ground state, which is designated by the bar over their label. As a load is applied to any of the diodes of optical couplers U12, U13 or U14, the 5 volt power turns on the respective diode, which emits photons to turn on the base of its respective transistor, which then allows the 12 volt power to flow through the transistor. As the data lead is grounded, the particular transistor that it is associated with is turned on.

When bank enable relay K1 is enabled, as previously described, 12 volts is connected to fuse F3, shown at the top of FIG. 5, and to fuse F2, located between couplers U13 and U14. This causes power to be available for transistors Q1, Q2, Q3, and Q4.

Transistors Q1, Q2, Q3, and Q4 form what may be referred to as a quadrature transistor bank. Their outputs may be considered parallel and are connected to the motor windings. To operate motor M1 up or down, two transistors diagonal to each other are enabled. For example, to operate the "up" direction, transistor Q1 would be turned on to supply 12 volts at terminal C, i.e. the collector. This 12 volts is supplied to terminal block 2, terminal 1 and 2 (see FIG. 3, upper left), which is in turn connected to the positive side of lift motor M1. The computer would also enable Q4, which connects through terminal C of Q4 to terminal block 2, terminals 3 and 4, which is connected to the negative side of the motor M1. Therefore, the 12 volt source is supplied by Q1 to the motor. The ground would then be supplied by Q4. If PB2 of the hand control box were depressed, requesting the down direction, transistor Q2 would supply 12 volts and transistor Q3 would supply the ground.

As mentioned, the swing motor M2 is a two winding type motor. The left winding (i.e. the winding causing the motor to move the boom left) is operated by transistor Q5. The right winding is operated by transistor Q6. The common connection of motor M2 is tied to ground. Therefore, one or the other of transistors Q5 or Q6 would be enabled to supply 12 volts to the appropriate motor winding. At terminal block 2, terminals 5 and 6 or at terminal block 2, terminals 9 and 10.

Figure 6:
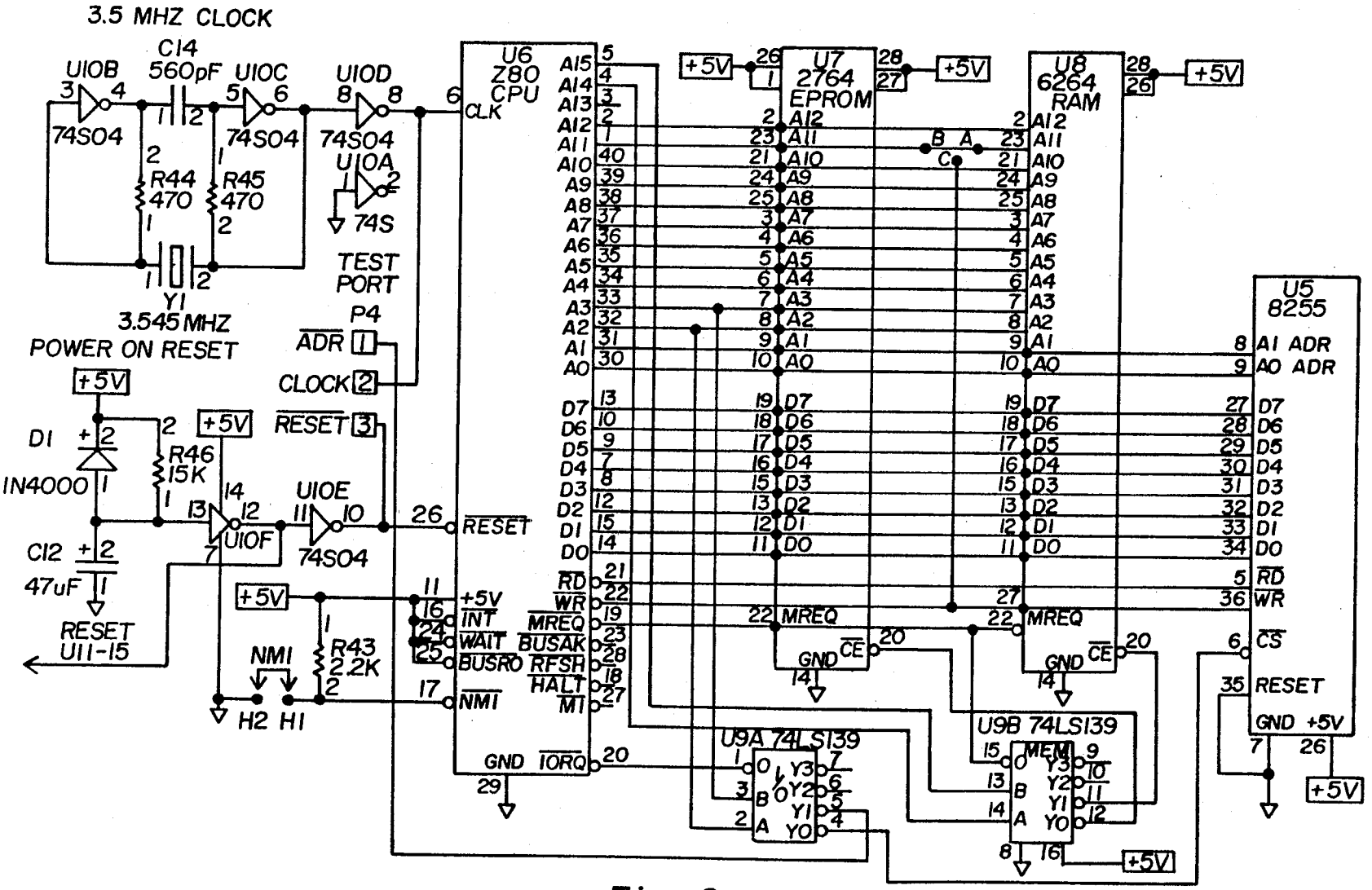

A description of what may be referred to as the computer or microprocessor of the system is more completely described in reference to FIG. 6. In the upper left-hand corner of FIG. 6 is a schematic of a module labeled "3.5 Megahertz clock U10." This module produces an oscillating signal that synchronizes the computer timing. Module U10 may be replaced by a 74SO4 OR OSC module. The clock signal produced by clock U10 enters the CPU U6 at terminal 6, as shown. CPU U6 is a Z80 chip.

A power on reset is connected at pin 26 to cause a reset on U6 after a power-up condition, after which the reset is released. After the reset is released, microprocessor U6 executes its software program.

A pair of jumpers, H1 and H2, are connected as shown in the lower left-hand portion of FIG. 6. These jumpers provide the ability to access a test function that may be programmed into the compute. In the illustrated embodiment, this jumper is not used and the input labeled NMI at pin 17 of CPU U6 is held in an inactive condition.

CPU U6 is connected with memory chips U7 and U8. U7 is a 64K 2764 EPROM. Chip U8 is a 6264 RAM. CPU U6 is also connected to chip U9 (U9*a* and U9*b*), shown at the bottom of FIG. 6, which is a 74LS139 device decoder. As the CPU attempts to communicate with various sections of the device, for example, the PIO U5, CPU U6 emits a device address, which device decoder U9 decodes to operate either the EPROM U7, RAM U8, or PIO U5. The addresses from the CPU to the EPROM and RAM and other devices are parallel. When these devices are enabled, they communicate with the CPU. The CPU controls these devices through the leads labeled A0 through A15 on CPU U6. The leads labeled D0 through D7 on chip U6 are referred to as the data bus. Information that is passed from device to device is transmitted on the D0 through D7 leads.

FIG. 4 illustrates features of the sensing means including limit switch input. Resistors R6 through R10 are connected as shown in the upper left-hand corner of FIG. 7. 5 volts are supplied as shown through these resistors to invertors U4*a*, U4*b*, U4*c*, U4*d*, and U4*e*, which are all incorporated in a U4 chip. When 5 volts is presented at pin connections 1, 3, 5, 9, or 11, of chip U4, a ground potential is provided at pin 14, 15, 16, 17, or 37, respectively, of chip U5.

When one of limit switch inputs S7, S8, S9, S10, or S11 is closed, a load is provided to the U4 invertors, which in turn presents a high logic output at the terminals labeled C0, C1, C2, C3, or A7 of the U5 chip. These sensing means including limit switches are connected to the lifting device at various positions in order to make the device stop at a desired location. Electrical limit switches are preferred to providing a hard mechanical limit.

At the right side of FIG. 7 is a speed control circuit. By closing one or more switches DSW1, DSW2, DSW3, and/or DSW4 in a particular configuration, to present at terminals 10 through 13 of PIO chip U5, a preselected binary code. When the lifting device is in the swing mode, swinging left or right, the computer reads the digital input at terminals 10 through 13 of chip U5 to determine the selected speed for motor M2. By allowing the speed control to be changed by switches DS1-4, the speed does not need to be placed in the program or in memory, but can be quickly changed manually according to the preference of the user, either by the user himself or by a service person.

Connected to terminal 24 of U5 is an attendant call relay. When the attendant button is depressed at the control box (FIG. 1), the computer energizes the attendant call relay to provide a dry contact, meaning a no-voltage open or closed condition. When the attendant relay is energized, it provides a switch in a closed position at plug P5, terminals 1 and 2.

Attached at terminal 25 of chip U5 is the bank enable relay K1, previously described. When relay K1 is energized, LED 1, which is a light-emitting diode, is activated to emit light. LED 1 is on the circuit board. If any of the buttons are depressed at the hand control box, LED 1 will light up, indicating that the relay K1 is energized. LED 1 will stay lit, even if a limit switch is in operation or if conflicting commands, such as "up" and "down" at the same time are requested at the control box, or if the computer has shut down the motor.

Figure 8:
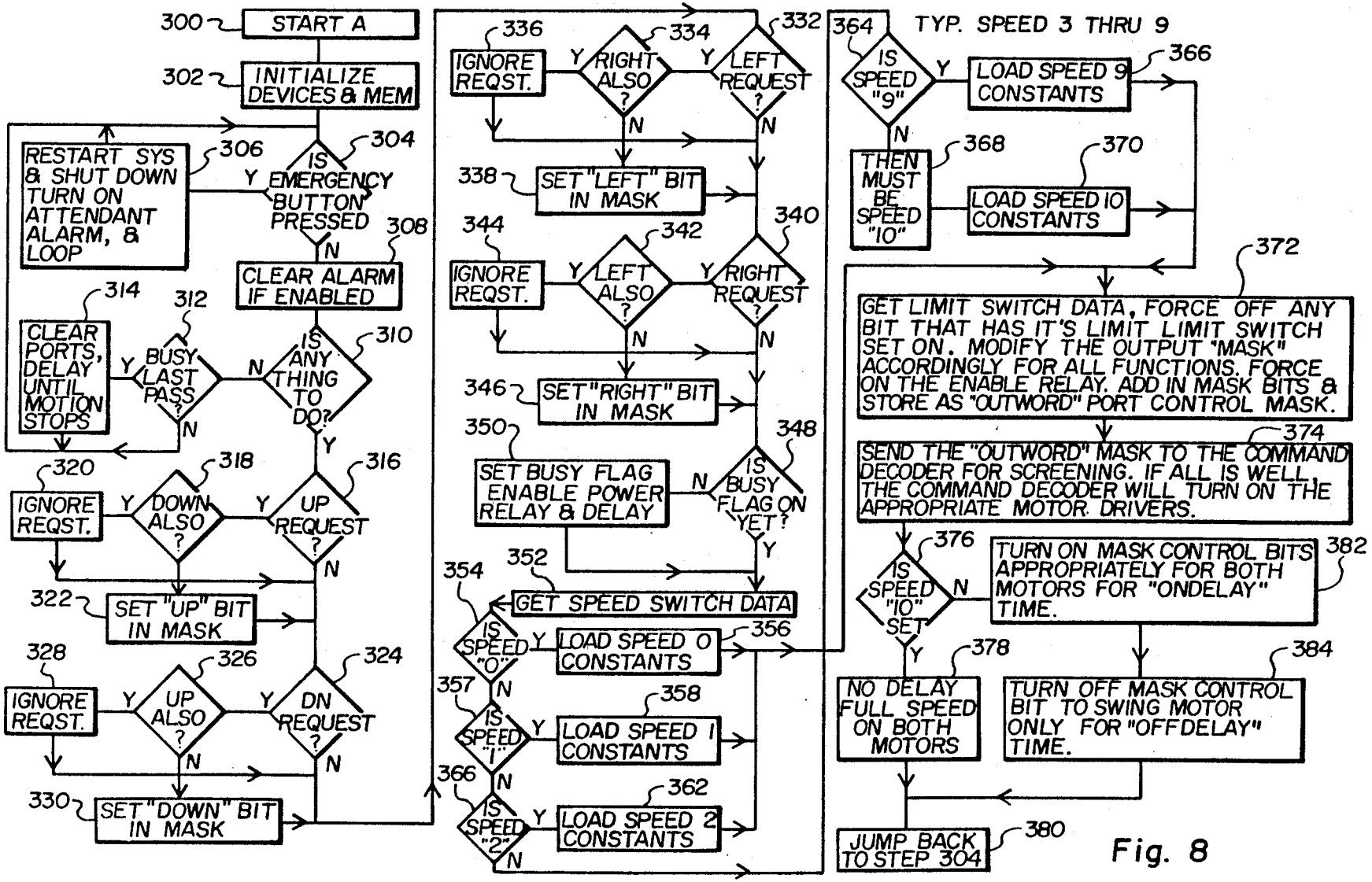
FIG. 8 is a block diagram of a computer program by which the lifting device operates.

A description of the software that operates the microprocessor is described in reference to FIG. 8. When the power is turned on to the device, the power on reset circuit associated with pin 26 of U6 (FIG. 6) deactivates the reset to allow CPU U6 to allow the program to begin. Referring to FIG. 8, step 1 is labeled "start." At step 302, the program initializes the devices and the memory. The RAM is a variable memory that stores temporary information and status for later recall or reference. The computer must create personalities for the various devices and must initialize the devices, i.e., tell what parts serve what function, clear the memory locations, and input appropriate initial information.

At step 304, the program asks: "is the emergency button pressed?" If the answer is "yes," the program moves to step 306 to restart the system and turn off the motor drivers and relays. The program turns on the attendant alarm relay and continues looping through steps 304 and 306 to continue to ask if the emergency button is still pressed. If the emergency button is still pressed, the program continues in this tight loop and does nothing else.

When the button is released, or if the emergency button was never pressed, then the answer at step 304 is "no." If the answer is "no" at step 304, step 308 clears the attendant alarm if it has been enabled. At step 310, the computer asks itself: "Is there anything to do?" In other words, the computer asks itself whether anyone has pressed either an "up/down" or "left" or "right" button. If the answer is "no" at step 312 the computer asks itself if it was busy last time step 312 was encountered. If the answer to this question is "yes," the computer has reacted to the fact that a button has been released since the last pass through this step. If the answer is "yes," step 314 shuts down the motors, clears out relevant memory information, and shuts the motors off. The program then delays a period of time before looping back to step 304. Since the button has been released since the last pass, this delay at step 314 allows the motor a short period of time to stop before the program asks itself if there is anything else to do.

At step 312, if the answer is "no," the program loops immediately back to step 304. If the answer is "yes" at step 310, the program asks itself whether there has been an "up" request at step 316. In other words, the program asks itself whether anyone has depressed the "up" button. If the answer is "yes," the program then asks at step 318, if there has also been a "down" request, in other words, has the user also depressed the "down" button. If the answer to test 318 is also "yes," both requests are ignored at step 320.

At step 318, if the answer is no, in other words, if the user has depressed an "up" button and has not also depressed a down button, at step 322 the program creates a word that may be referred to as an outword mask. In this mask, there are a number of binary bits or pieces, each referring to some function in the machine. In this particular case, "up" was requested. The "up" request was not contradicted, so the program sets up an "up" bit. At this point, the program maintains this "up" bit in the RAM memory.

The program then runs test 324 to ask if a "down" request has been made. The answer to this question at this time will be "no," since the program has arrived at this point step 322 as a result of a "no" at step 318, which also asks if a "down" request had been made.

Step 324 is also arrived at if test 316 is negative, in other words, if no "up" request has been made at step 316. At this point, at test 324 the answer can be either "yes" or "no." If the answer to test 324 is "yes," the program runs through tests 326, 328 and 330, which correspond to steps 318, 320 and 322. From step 328, or step 330, or if the answer to test 324 is "no," the program moves to test 332 to ask itself if a "left" request has been made. The program then runs through the sequence of test 334, test 336, and step 338 in the same manner as program steps 316 through 322 with regard to the left request test. The program then runs through test 340, test 342, step 344, and step 346 to, in the same fashion, ask whether a "right" request has been made, i.e. whether the user depressed the right movement button without also depressing the left movement button.

At test 348, the program asks: "Was I busy last time?" In other words, the program asks if a busy flag is on. If the answer is "no," at step 350, program turns on the 12 volt power relay K1 and executes a short delay to allow this relay to cease any bouncing that may occur. If the answer is "yes," meaning that one of the motors has already been started and now the program has looped again to step 348, there is no need to enable the relay.

The program then moves to step 352, in which the computer obtains the speed switch data from the speed control in the upper right-hand corner of FIG. 7, i.e. the binary code number established at DSW1, DSW2, DSW3, and DSW4, as previously described. All of these switches turned off represents a zero, at which time the motor is set to 50% of full speed. The number 1 represented at the switches would indicate a speed at 55%. An increase of one number between 0 and 10 indicates to the computer an increase of 5% of full speed, so that at number 10, the speed would be 100%. These speeds are determined by running through a series of tests as represented by test 354, at which the program asks, "is the speed 0?" If the answer is "yes," step 356 causes the speed zero constant to be loaded. If the answer is "no," the program runs test 357, which asks "is the speed 1?" Again, if the answer is yes, the program at step 358 loads a 1 speed constant. If the answer is "no," the program runs test 360 to ask if the speed is 2. The program runs through similar tests represented by step 362, test 364, and step 366, until the program has asked whether the speed is 9. If the answer to test 364 is "no," then at step 368 the program determines that the speed must be 10. Any number over 9 is read as a 10, and then at step 370 the program loads 10 speed constants.

After any of the speed constants have been loaded, i.e. either speed constants 1 through 9, or 10 speed constants, the program moves to step 372. At step 372, the program obtains any limit switch data from the limit switch inputs shown on FIG. 7 and connected to U5 at pins 14, 15, 16, 17, and 37, as previously described. The limit switch information is obtained by the microprocessor U8 as it reads this 8 bit port. At the same time, the microprocessor receives the speed switch information, which is not needed at this point. Therefore, the program strips off the speed switch information.

The remaining data is then inverted, meaning ones become zeros and zeros become ones. Once the information is inverted, the program performs a mathematical or logical "AND" function, meaning that if the speed switch was set having a logic 1, it is changed to a logic 0. For an AND function to operate, it must have a 1 anded with a 1 in order for a 1 to be output. If a limit switch is in a limit condition, the input will be a 1, which when inverted is a 0. A zero anded with a 1 will output a 0. An output of 0 sent to the motor drivers causes nothing to happen. Therefore, any function in a limit condition blocks operation of its corresponding motor.

Once the bit mask is created, which is a representation of which motors are requested to be operated, after having been screened through any mechanical limit switch conditions, a mask is created which is referred to as an "outword." At step 374, the outword mask is sent to the PIO U5, which in turn relays the information to the transistor drivers U13, and U14 (FIG. 5).

At test 376, the program asks if speed 10 is set. If the answer is "yes," at step 378, no delay is created, but full speed is applied to both motors. Only the appropriate motor that has been selected will actually be turned on, however, as determined by the turning on of the appropriate motor drivers at step 374. From step 378, the program, at step 380 jumps back to step 304.

If at step 376, speed 10 is not set, in other words if the answer to test 376 is "no," at step 382, the program runs a duty cycle in which the program turns the motor on and off for a period of time corresponding to the speed constants set. This is accomplished by step 382 which turns on the mask control bits appropriate for both motors for the on time. At step 384, the program turns off the mask control bit to the swing motor only, for the off time delay. The speed control operates only the swing motor and not the up and down motor at this time. The up and down motor always operates at full speed. From step 384 the program moves to step 380, which jumps back to step 304 as previously described.

The speed of swing motor 26 is controlled by operating motor 26 in a duty cycle. The period of each cycle is 10 milliseconds. If a 60% speed is selected, the computer will turn motor 26 on for 6 milliseconds and off for 4 milliseconds repetitively while the motor is energized.

The program may also be adapted to gradually either start or stop swing motor 26 by controlling the percentage of on and off time according to an algebraic function until the target speed is achieved. For example, if an 80% speed is selected, the program would begin operation of motor 26 at 50% speed and accelerate this speed over a period of perhaps one second, until the 80% speed is achieved. The rate of acceleration may be selected as a constant over this time period, or some other function-driven rate. At present, it is believed that an exponential increase in the rate of acceleration is preferred, with the rate of acceleration increasing as the target rate is approached. When swing motor 26 is stopped, the exact reverse of this rate function may be used. An exponential increase and decrease in acceleration rate is believed to provide a minimum of swinging action upon either starting or stopping swing motor 26.

In embodiments having a gradual stopping function, the release of a function (release of control box 32 button) only begins the deceleration. This slow deceleration may provide a potential panic for the user, because the device doesn't stop immediately. However, the attendant call/panic/reset button may be pressed to immediately terminate all motor operation. As the user becomes more experienced in anticipating this "coast" period, the problem is alleviated.

Reference herein to details of the illustrated embodiment are not intended to limit the scope of the appended claims, which themselves recite those features regarded important to the invention.

What is claimed is:

1. A human lifting device, comprising:

a stationary frame;

a mast pivotally mounted to said frame, said mast being rotatable about a generally vertical axis;

lifting means mechanically associated with said mast for raising and lowering a person, said lifting means being pivotally mounted to said mast to provide rotation about a generally horizontal axis associated with said pivotal mount, said lifting means being rotatable with said mast and having means for connection to said person to be moved;

first drive means mechanically linked with said mast and said frame for selectively urging said mast to rotate about said generally vertical axis;

second drive means mechanically linked with said lifting means for selectively urging said lifting means to rotate about said generally horizontal axis;

input means associated with said lifting device for receiving rotational signals and elevational signals from an operator;

control means associatively linked with said first drive means, said second drive means, and said input means for selectively controlling said first drive means and said second drive means, said control means being adapted to receive data from said input means corresponding to rotational movement of said mast, receive data from said input means corresponding to elevational movement of said lifting means, encode said data corresponding to rotational and elevational movement within structure associated with said control means, provide said encoded data corresponding to rotational movement to said first drive means, and provide said encoded data corresponding to elevation movement to said second drive means; and sensing means associated with said frame, said mast, and said lifting means for perceiving the spatial orientation of said lifting means and said mast, said sensing means being in communication with said control means to relay to said control means information relating to said spatial orientation.

2. A human lifting device according to claim 1 wherein said lifting means includes a boom pivotally attached to said mast to pivot up and down about a said horizontal axis.

3. A human lifting device according to claim 1 wherein said input means further includes speed selection means for receiving a selected rotational speed at which said first drive means is to operate, said control means being further adapted to control said first drive means according to said selected rotational speed.

4. A human lifting device according to claim 3 wherein said control means is adapted to control the speed of said first drive means by operating said first drive means in a duty cycle mode.

5. A human lifting device according to claim 4 wherein said control means is adapted to start and to stop said first drive means on a gradual basis.

6. A human lifting device according to claim 1 wherein said first drive means includes a first motor.

7. A human lifting device according to claim 6 wherein said first motor is drivingly connected to said mast by means of a pinion gear.

8. A human lifting device according to claim 1 wherein said second drive means includes a second motor.

9. A human lifting device according to claim 8 wherein said second motor is drivingly connected to said boom by means of a screw gear.

10. A human lifting device, comprising:

a stationary frame;

a mast pivotally attached to said frame to rotate about a generally vertical axis;

a boom pivotally mounted to said mast to pivot about a generally horizontal axis;

an extendible and retractable strut mechanically linked between said mast and said boom to raise said boom upon extension of said strut or to lower said boom upon retraction of said strut;

first drive means mechanically linked to said mast for selectively rotating said mast relative to said frame about said vertical axis;

second drive means mechanically linked to said strut for selectively extending or retracting said strut;

input means associated with said lifting device for receiving elevational and rotational signals from a user;

a computer associatively linked with said first drive means, said second drive means, and said input means for controlling said first and second drive means, said computer being programmable to receive signals from said input means corresponding to rotational movement of said mast, receive signals from said input means corresponding to elevational movement of said boom, encode said data corresponding to rotational and elevational movement within structure associated with said computer, provide said encoded data corresponding to rotational movement to said first drive means, and provide said encoded data corresponding to elevational movement to said second drive means; and sensing means associated with said frame, said mast, and said boom for perceiving the spatial orientation of said boom and said mast, said sensing means being in communication with said computer to relay to said computer information relating to said spatial orientation.

11. A human lifting device according to claim 10, wherein said input means includes speed selection means for receiving from a user a selected rotational speed at which said first drive means is to operate, said computer being further programmed to control said first drive means according to said selected rotational speed.

12. A human lifting device according to claim 11, wherein said computer is programmed to operate said computer in a duty cycle.

13. A human lifting device according to claim wherein said computer is programmed to start and to stop said first motor on a gradual basis.

14. A human lifting device according to claim 11, wherein said first drive means includes a motor drivingly connected to said mast by means of a pinion gear.

15. A human lifting device according to claim 14, wherein said second drive means includes a motor drivingly connected to said strut by means of a screw gear.

16. An invalid lifting device, comprising:

a stationary frame;

a mast mounted to said frame to rotate about a generally vertical axis;

a first floor mechanically linked with said mast to selectively rotate said mast either clockwise or counterclockwise;

a boom pivotally mounted to said mast to pivot about a generally horizontal axis;

an extendible and retractable strut attached to said mast and to said boom to raise or lower said boom upon extension or retraction, respectively, of said strut;

a second motor mechanically linked with said strut to selectively extend or retract said strut;

input means associated with said lifting device for receiving rotational and elevational data from a user;

a computer operatively connected to said input means, said first motor and said second motor to selectively and operatively control said first motor and said second motor, said computer being programmable to receive data from said input means corresponding to rotational movement of said mast, receive data from said input means corresponding to elevational movement of said boom, encode said data corresponding to rotational and elevational movement within structure associated with said control means, provide said encoded data corresponding to rotational movement to said first motor, and provide said encoded data corresponding to elevational movement to said second motor; and sensing means associated with said frame, said mast, and said boom for perceiving rotation of said mast about said vertical axis and rotation of said boom about said horizontal axis, said sensing means being in communication with said computer to relay to said computer information relating to said rotation.

17. An invalid lifting device according to claim 16 further comprising limit switch input means associated with said mast for providing limit switch data to said computer, said computer being programmed to control said first motor to cease rotational motion of said mast based upon said limit switch data.

18. An invalid lifting device according to claim 17 wherein said computer is programmed to operate said first motor in a duty cycle mode.

19. An invalid lifting device according to claim 18 wherein said computer is programmed to start and stop said first motor on a gradual basis.

* * * * *

UNITED STATES PATENT AND TRADEMARK OFFICE

CERTIFICATE OF CORRECTION

PATENT NO. : 5,077,844

DATED : January 7, 1992

INVENTOR(S) : Kendel S. Twitchell & Elden K. Twitchell

It is certified that error appears in the above-identified patent and that said Letters Patent is hereby corrected as shown below:

In Column 2, line 65 after "sling" insert -- 38 --;

In Column 15, line 27, delete "a" before -- said --;

In Column 16, line 47, change "floor" to -- motor --.

Signed and Sealed this

Seventeenth Day of August, 1993

*Attest:*

*Attesting Officer*

Bruce Lehman

BRUCE LEHMAN

*Commissioner of Patents and Trademarks*